United States Patent [19]

Koppenberg

[11] Patent Number: 4,881,714

[45] Date of Patent: Nov. 21, 1989

[54] CONCRETE MOLDING SYSTEM WITH TUBS

[76] Inventor: Bruce G. Koppenberg, 9674 Mt. Baker Hwy., Deming, Wash. 98244

[21] Appl. No.: 215,268

[22] Filed: Jul. 5, 1988

[51] Int. Cl.[4] ..... B28B 7/16; E04H 13/00

[52] U.S. Cl. ..... 249/60; 249/31; 249/35; 249/91; 249/96; 249/151; 249/163; 249/176; 249/177

[58] Field of Search ..... 249/16, 31, 32, 35, 249/39, 60, 64, 91, 93, 94, 142, 144, 151, 167, 176, 177, 96, 97, 163

[56] References Cited

U.S. PATENT DOCUMENTS

| | | | |
|---|---|---|---|
| 1,278,286 | 9/1918 | Ambursen | 249/31 |
| 1,289,069 | 12/1918 | Ambursen | 249/31 |
| 1,388,273 | 8/1921 | Leffler | 249/31 |
| 1,497,930 | 6/1924 | Mohrman et al. | 249/31 |
| 1,616,846 | 2/1927 | Duncan et al. | 249/176 |
| 1,841,074 | 1/1932 | Wolff | 249/35 |
| 2,544,602 | 3/1951 | Kosorotoff | 249/176 |
| 3,314,638 | 4/1967 | Morrison | 249/176 |
| 3,543,458 | 12/1970 | Guritz | 249/176 |
| 3,584,826 | 6/1971 | Liester | 249/35 |
| 4,566,668 | 1/1986 | Koppenberg | 249/176 |
| 4,614,066 | 9/1986 | Koppenberg | 52/134 |

FOREIGN PATENT DOCUMENTS

| | | | |
|---|---|---|---|
| 106228 | 1/1939 | Australia | 249/31 |

*Primary Examiner*—James Housel

*Attorney, Agent, or Firm*—Kolisch, Hartwell & Dickinson

[57] ABSTRACT

Concrete molding apparatus that includes an integral lattice frame having a first set of elongated expanses extending in one direction on the frame and a second set of elongated expanses extending transversely of the first set. These expanses define openings in the lattice frame and tub molds are detachably mounted in these openings. In the mounting of a tub mold, a retaining bar structure is provided paralleling an expanse in one of said set of expanses and detachable fasteners distributed along the length of a bar structure detachably fasten the bar structure to the expanse of the lattice frame.

2 Claims, 3 Drawing Sheets

CONCRETE MOLDING SYSTEM WITH TUBS

BACKGROUND AND SUMMARY OF THE INVENTION

The instant invention relates to concrete molding systems, and specifically to a system for molding columbarium modules.

A variety of systems for forming columbarium units are known. One such system is disclosed in my prior issued U.S. Pat. No. 4,566,668, APPARATUS FOR CASTING CONCRETE. While the invention disclosed in that patent is useful for forming a one-sided unit, the formation of a double-sided unit with the previously disclosed invention requires joining two single-sided units. The apparatus disclosed in that patent requires that the unit be cast in a horizontal condition, with the niches facing downwardly. This precludes the formation of a second side of the unit with the niches facing upwardly.

Anchors must be integrally formed in a columbarium module when the module is cast for securing niche-plate or slab-hangers to the module. The location and type of anchors are determined by the size of the marking slabs to be used by the mausoleum operators. If the location and type of these slab-hanger anchors were uniform, a single set of bores could be provided in the system for securing the anchors thereto. However, because of the variety and location of the anchors, some means is required for providing custom placement of varying types and sizes of anchors in a columbarium module without sacrificing the structural integrity of the molding system.

An object of the instant invention is to provide a molding system which provides a means for easily installing and removing tub molds which are used to form the individual niches in a cast columbarium module.

Another object of the instant invention is to provide a molding system which forms a concrete-tight seal between a tub mold and a lattice-frame work of the system.

A further object of the instant invention is to provide means for selectively positioning slab-hanger anchors in a module.

Yet another object of the instant invention is to provide a molding system which is suitable for forming both one and two-sided columbarium units.

The system of the instant invention is intended for use with tub molds wherein the tub molds each have a closed end, a substantially open end, sides extending between the closed and open end and a perimeter rim adjacent the open end which rim is integrally formed with the sides of the mold and which projects outwardly from the sides. A lattice frame includes a first set of multiple elongate expanses, paralleling and laterally spaced from each other and extending in one direction in the frame and a second set of multiple elongate expanses, paralleling and laterally spaced from each other extending transversely of said first set and joined therewith. The sets of expanses form openings in the frame to receive the tub molds therein. Receiver means are located on the expanses for removably receiving a retainer means thereon. The retainer means is operable to retain the molds in the frame by capturing the perimeter rim of the mold between an expanse and the retaining means. An anchor positioning structure is provided for removably fastening anchors thereto, which in turn is removably fastenable to the lattice frame.

These and other objects of the instant invention will become more fully apparent as the description which follows is read in conjunction with the drawings.

DETAILED DESCRIPTION OF THE DRAWINGS

DETAILED DESCRIPTION OF THE PREFERRED EMBODIMENTS

Figure 1:
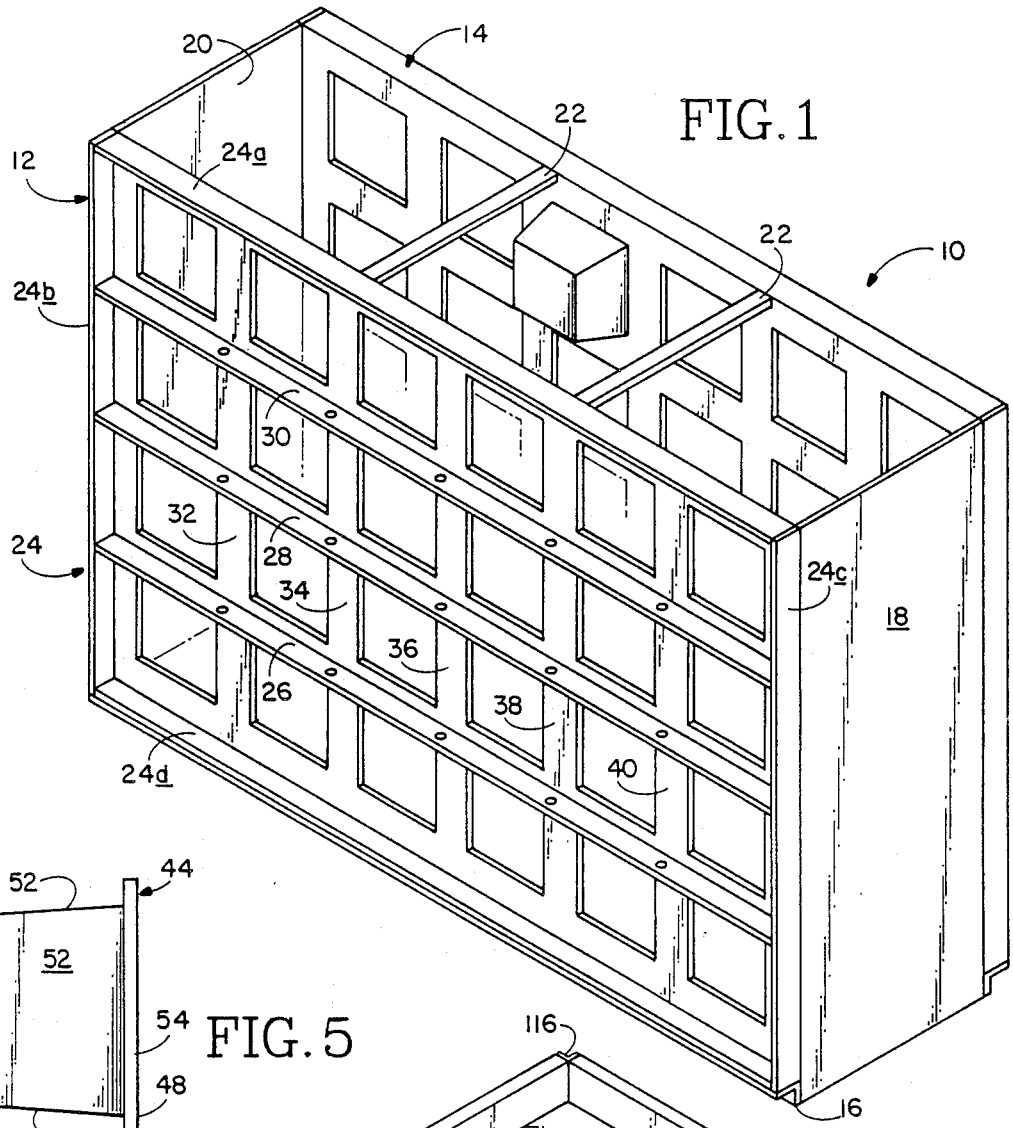
FIG. 1 is a perspective view of the molding system of the invention.

Referring now to the drawings, and initially to FIG. 1, the system, or mold assembly, of the invention is depicted generally at 10. In the first embodiment, system 10 includes a pair of similarly constructed lattice frames 12 and 14 which are positioned on a pouring base 16 and which are spaced apart by pouring sides 18 and 20. This embodiment is designed to form a double-sided columbarium unit. Frames 12 and 14 have one face which faces outwardly of the assembly, and a rear face which faces toward the interior of the assembly. Cross members 22 extend between frames 12 and 14 to maintain the desired spacing between the frames.

Figure 2:
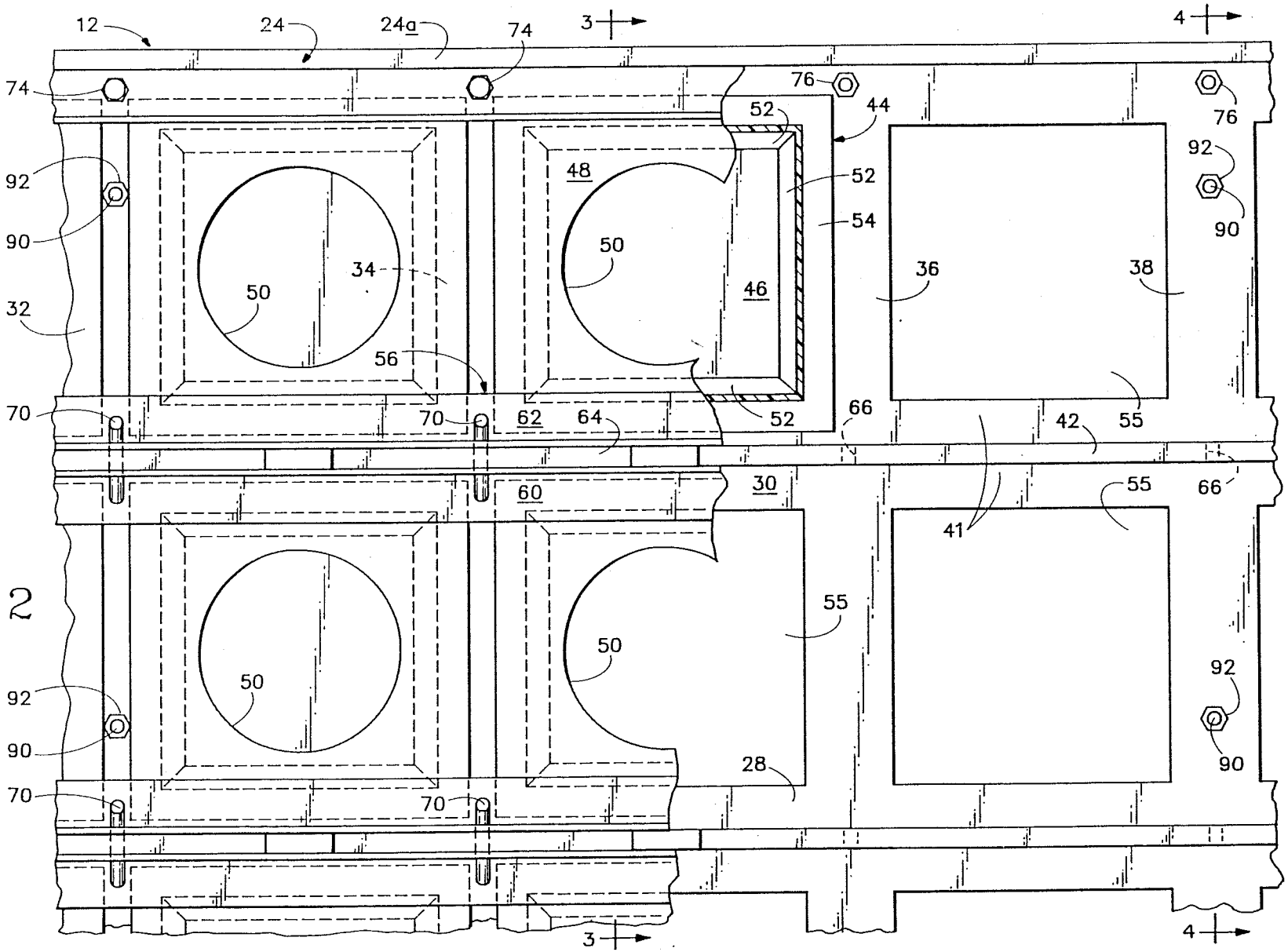
FIG. 2 is an enlarged front plan view of a portion of a lattice frame of the invention, with tub molds received therein, and having portions broken away to show detail.

Referring now to FIGS. 1 and 2, frames 12 and 14 include an outer frame perimeter 24 which extends about the periphery of the individual lattice frames and which, in the preferred embodiment, is formed of 90° angle iron. Perimeter 24 includes an upper portion **24*a*, side portions 24*b*, 24*c* and a bottom portion 24*d*. A first set of multiple elongate expanses, including expanses 26, 28 and 30, run parallel to one another, are laterally spaced from each other and extend in a first, horizontal direction. A second set of expanses, represented by expanses 32, 34, 36, 38 and 40**, extend parallel to one another are laterally spaced from each other and extend in a second direction, transverse of that of the first set of expanses. The expanses of the second set are joined to the expanses of the first set where the expanses cross one another. It should be appreciated that the number of expanses in a set may be changed to form a columbarium module having any desired number of horizontal or vertical rows of niches.

Figure 3:
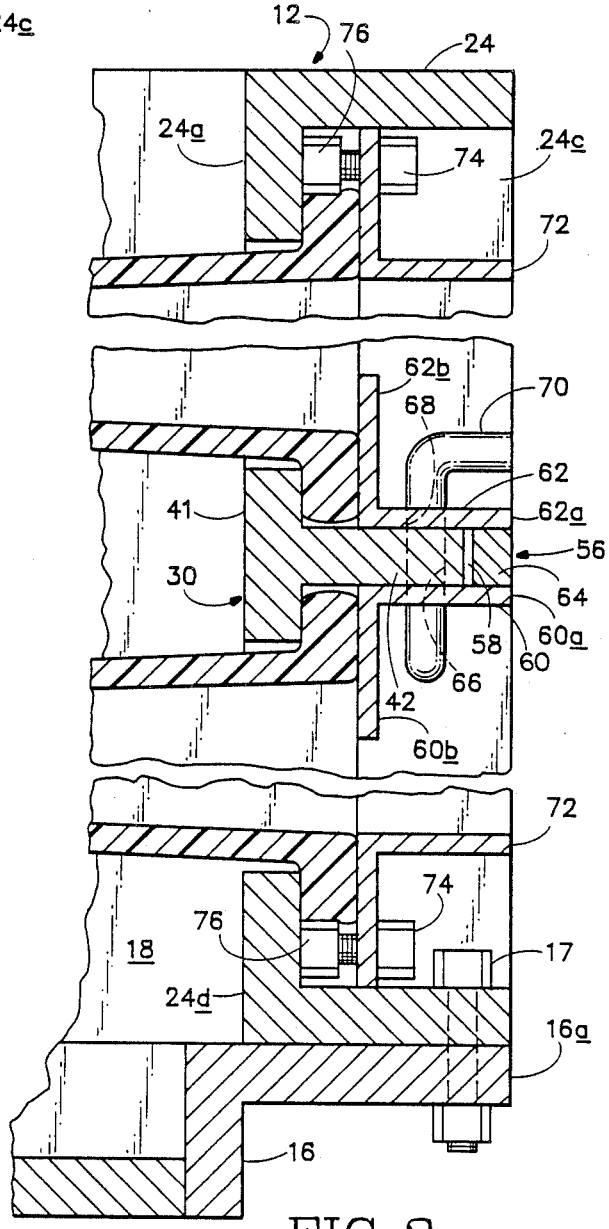
FIG. 3 is a side sectional view of one face of the system, taken generally along the line 3—3 of FIG. 2.

In the preferred embodiment, the first set of expanses are joined to outer frame perimeter portions **24*b*, 24*c*, and are formed of "T" irons, having, when viewed in cross section as in FIG. 3, cross pieces such as cross piece 41 and legs such as leg 42** which project outwardly from the face of the cross piece. In the "T" iron, an elongate base web extending the length of the "T" iron forms the cross piece, and an elongate flange extending the length of the iron forms the leg. The second set of expanses are formed from flat straps which are secured to the cross pieces of the "T".

Figure 5:
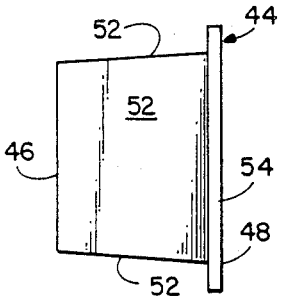
FIG. 5 is a reduced scale side elevation of a tub mold.

The system of the invention is intended for use with tub molds 44, which are conventional in design and which include, and now referring to FIGS. 2, 3 and 5, a closed end 46 and a substantially open end 48. Open end 48 has a web partially extending across the open end thereof with a circular orifice 50 formed therein. Mold 44 includes four sides 52 which extend between closed end 46 and open end 48 and which have an integrally formed perimeter rim 54 extending about open end 48 laterally away from sides 52. Sides 52 slope slightly inwards between open end 48 and closed end 46, providing closed end 46 with slightly smaller overall dimensions than open end 48. This structure is utilized to provide easy removal of tub molds from the completed structure.

The tub molds are insertable into openings 55 formed between the expanses in lattice frames 12 and 14. Referring now to FIG. 3, portions of tub molds 44 are depicted with the molds received in openings 55 in lattice frame 12. The closed end of the molds are arranged to project to the interior of frames 12 and 14, with perimeter rims 54 contacting the outwardly facing surface of the lattice frame thereby preventing complete passage of the mold through the frame.

Mold retainers, also referred to herein as mold retaining means 56, are provided to capture, with frames 12 and 14, perimeter rims 54 of molds 44. Specifically, and now referring to FIGS. 2 and 3, a perimeter rim is captured between an expanse, such as expanse 30, and a mold retainer 56 to prevent escape of the molds from the lattice frame when concrete is poured into the completed mold assembly.

Mold retainer 56 includes a channel 58 which is defined between a pair of spaced apart 90° angle pieces 60 and 62. A spacer 64 is located between pieces 60, 62 and fixed thereto, as by welding, to maintain precise spacing. Pieces 60, 62 have one arm 60*a*, 62*b*, thereof secured to spacer 64 while the other arm 60*b*, 62*b* faces the expanse and is operable therewith to capture perimeter rim 54. Channel 58 is formed between arms 60*a* and 60*b* and is constructed and arranged to fit over "T" leg 42, also referred to herein as a receiver flange means. Angle pieces 60, 62 and spacer 64 collectively from a channel-shaped element, with arms 60*a*, 62*a* constituting shoulders in this element defining channels 58 which extends along the element between the shoulders.

Receiver flanges 42 are operable for removably receiving retainer means 56 thereon. To this end, plural bores 66 are formed therein while bores 68 are formed in retainers 56. Bores 68 are aligned with bores 66 and are sized to allow pins 70, also referred to herein as keeper means, to be insertable through bores 66 and 68 thereby to maintain mold retainers on receiver flanges 42.

Although a flange 42 may be provided on the expanse defined by outer frame perimeter 24, because there is only one perimeter rim to be captured at this location, it is more economical to provide a mold retainer comprising a single piece of 90° angle bar, such as bar 72, which is attachable to outer frame perimeter 24 by means of fasteners, such as bolt 74 and nut 76. Nut 76 may be secured to frame perimeter 24 as by welding.

Figure 4:
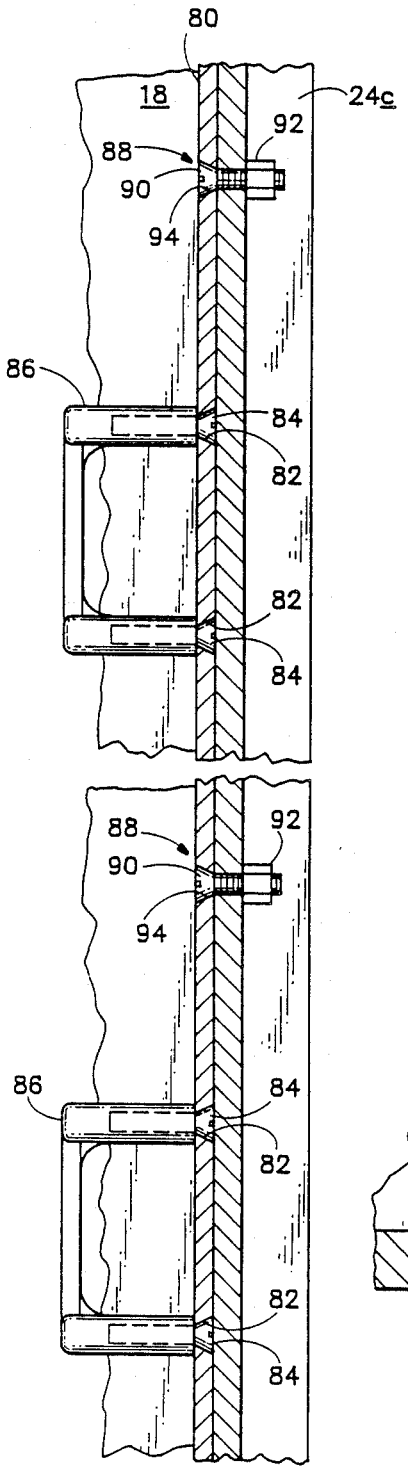
FIG. 4 is a side sectional view of anchor placement means of the invention, taken generally along the line 4—4 of FIG. 2.

Referring now to FIG. 4, anchor placement means of the invention are depicted generally at 88. Placement means 88 includes an elongate anchor positioning structure 80 which has countersunk bores 82 extending therethrough for receiving screws 84, which are received in tapped sockets in anchors 86. Anchors 86 are positioned along structure 80 at the desired locations and secured thereto by means of screws 84. Once the anchors are positioned on structure 80, the assembly is secured to the rear face of a vertical expanse. In the preferred embodiment, fasteners 88 take the form of screws 90 and nuts 92. Screws 90 are received in countersunk bores 94 in structure 80. The placement means may be secured to as many expanses as is necessary to provide a desired number of anchors in the finished module.

Placement means 88 allows the positioning of anchors 86 in desired locations without the necessity of drilling numerous bores in the vertical or horizontal expanses, which drilling would ultimately weaken the structural integrity of the lattice frame. Only one set of bores need be formed in the expanses, which are required to fasten the anchor positioning structure to the expanse. Various positioning structures may be provided with anchor positioning locations formed intermediate the ends thereof.

Figure 6:
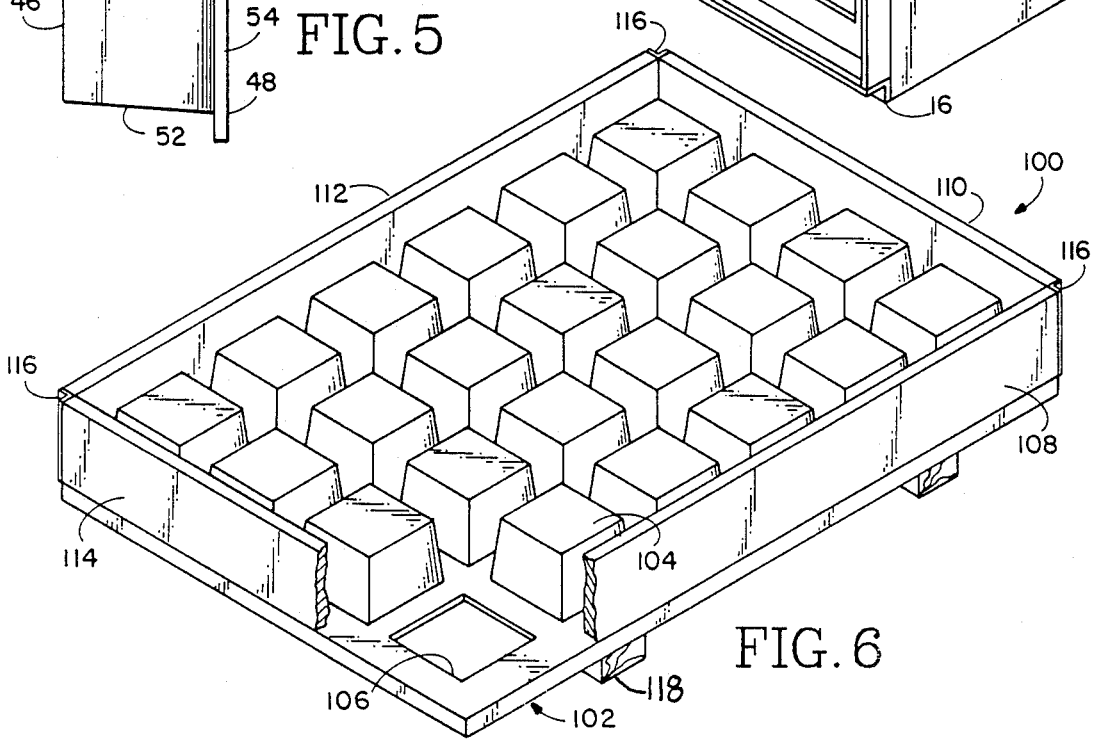
FIG. 6 is a perspective view of another embodiment of the molding system of the invention.

A second embodiment of the invention is depicted in FIG. 6 at 100. The second embodiment utilizes a lattice frame 102 which is constructed as are frames 12 and 14. Frame 102 includes all of the features of frames 12 and 14. Tub molds 104 are placed into openings 106 in the frame and secured to the frame by means of mold retainers, such as retainer 56 which was described in conjunction with frames 12 and 14. The process of inserting and retaining the molds in the frames would be accomplished with the frame in an upright, substantially vertical position, and some means may be provided to facilitate this placement.

Once the tub molds are secured to the lattice frame, the frame is rotated to a substantially horizontal position, as shown in FIG. 6, and mold sides 108, 110, 112 and 114 are secured about the periphery of frame 102 to define the edges of the finished columbarium module. Joiners 116 are located at the corners of the mold to retain the sides in a desired configuration. The entire system may be placed on a pallet, or on spacers 118, to facilitate insertion of the forks of a lift truck under the assembly to move the assembly.

This form of the invention is suitable as a mold for a single-sided columbarium unit.

A number of molds depicted in embodiment 100 may be assembled and poured nearly simultaneously, or the molds may be assembled and stacked, ready for use, thereby maintaining the individual components of the mold in an assembled, compact arrangement suitable for storage. In order to pour concrete into the assembled molds, the mold is merely shifted to any level location, and are filled with concrete. The units may rest on some form of pallet to allow access to the underside thereof by lifting equipment.

OPERATION

To further describe the manner in which the system of the invention is used, the components of the mold system are first assembled. Anchors 86 are initially secured to placement means 88 at desired locations. The placement means are then attached to the rear faces of the lattice frames. Lattice frames 12 and 14 are then secured to pouring base 16. Although this may be accomplished in a variety of ways, the easiest is to secure lower portion 24*d* of frame perimeter 24 to a flange 16*a* on base 16 by means of fasteners 17. Pouring sides 18 and 20 are next positioned, and again secured to lattice frames 12 and 14 and pouring base 16 by means of fasteners. Cross members 22 are positioned between frames 12 and 14 to complete the assembly.

Tub molds 44 are prepared for use by providing suitable lubricant about the outer sides and closed ends thereof, and the molds are then inserted through the openings in the lattice frames. The molds are held in place in the frame by mold retainers 56 which are positioned on flanges 42 and held in place by pins 70 and by mold retaining angle bars 72 which are secured to the lattice frame by means of bolts 74.

Once the tub molds are in place and are secured, concrete may be poured into the completed assembly and allowed to harden into the final product form. Steel bars may be positioned in the assembly prior to pouring concrete for reinforcement, if desired, as may lifting straps, which may be held in place by cross members 22 during the cement hardening process.

Once the concrete has fully set, the cross members and sides may be removed. Fasteners 17 and nuts 92 are next removed to allow removal of lattice frames 12 and 14 from the molded columbarium while leaving anchor placement means attached to the module. Once the lattice frames have been removed, screws 84 are removed, allowing removal of anchor positioning structure. The completed columbarium is lifted free of pouring base 16 and is ready for any remaining curing which the concrete must undergo, and shipment to its final resting place.

In the case of system 100, once the concrete has fully set, joiners 116 are removed from between adjacent sides and the sides removed from the lattice-frame work and from about the formed columbarium module. The module is then shifted to an upright position. The mold retainers are removed from the lattice frame and the molds are removed from the finished module. Next, the fastener securing the placement means to the lattice frame are removed, and the lattice-frame work is removed. The fasteners securing the placement means to the anchors are removed, allowing removal of the placement means, thereby leaving the finished module in a free standing condition.

Thus a concrete molding system has been disclosed which enables the rapid fabrication of a double-sided structure which may be used as a columbarium module. The system provides for the placement of anchors in the completed module in any desired location and orientation and provides for double-sided columbarium modules which are integrally formed.

Although a preferred embodiment of the invention and a modification thereto have been disclosed, it should be appreciated that further variations and modifications may be made thereto without departing from the spirit of the invention.

It is claimed and desired to secure as Letters Patent:

1. Concrete molding apparatus comprising:

an integral lattice frame including a first set of multiple elongate expanses paralleling and laterally spaced from each other extending in one direction in the frame, and a second set of multiple elongate expanses parallelling and laterally spaced from each other extending transversely of said first set and joined therewith, said sets of expanses forming openings in said frame and said expanses having front sides collectively forming the front of the lattice frame and rear sides collectively forming the rear of the lattice frame, a plurality of tub molds mounted in said frame, one mold in each respective one of said openings, the tub molds having a closed rear end, sides, and a front end and further including a perimeter rim extending about the front end, said molds being mounted with said rims against the front side of said expanses and said closed ends exposed rearwardly of the rear side of the frame, an elongate retaining bar structure paralleling each expanse in one of said sets of expanses and disposed in front of the expanse associated therewith, the retaining bar structure bearing against mold perimeter rims disposed intermediate the bar structure and the expanse associated with the bar structure, and plural detachable fasteners distributed along the length of each bar structure detachably fastening the bar structure to the expanse of the frame associated with the bar structure, an elongate expanse in said one of said sets of expanses including a base web extending therealong and an elongate flange joined to and projecting from the base web, the rims of said molds lying against the base web and said detachable fasteners securing the retaining bar structure to said flange, the retaining bar structure being an elongate channel-shaped element with opposed shoulders defining a channel extending therealong and said bar structure being mounted with said shoulders straddling said flange.

2. The apparatus of claim 1, wherein said detachable fasteners comprise sets of registering bores in said channel-shaped element and said flange, and keepers inserted through said sets of registering bores.

* * * * *